US006401692B1

(12) United States Patent
Grieshaber et al.

(10) Patent No.: US 6,401,692 B1
(45) Date of Patent: Jun. 11, 2002

(54) METHOD FOR CONTROLLING A COMMON RAIL INJECTION SYSTEM

(75) Inventors: Hermann Grieshaber, Aichtal; Heribert Haerle, Kornwestheim, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/621,661

(22) Filed: Jul. 24, 2000

(30) Foreign Application Priority Data

Jul. 24, 1999 (DE) ..... 199 34 833

(51) Int. Cl.[7] ..... F02M 41/00
(52) U.S. Cl. ..... 123/456; 123/492; 123/564
(58) Field of Search ..... 123/492, 456, 123/447, 946, 564; 60/605.1, 611

(56) References Cited

U.S. PATENT DOCUMENTS 4,512,152 A * 4/1985 Asaba ..... 60/601
4,711,200 A * 12/1987 Kinoshita ..... 123/492
4,841,936 A 6/1989 Takeshi
5,313,924 A * 5/1994 Regueiro ..... 123/456
5,622,152 A * 4/1997 Ishida ..... 123/446
5,769,052 A * 6/1998 Oestreicher et al. ..... 123/383

FOREIGN PATENT DOCUMENTS

EP 0 812 981 12/1997

* cited by examiner

*Primary Examiner*—Willis R. Wolfe
*Assistant Examiner*—Mahmoud Gimie
(74) *Attorney, Agent, or Firm*—Kenyon & Kenyon

(57) ABSTRACT

A method for controlling a common rail injection system for turbochargeable internal combustion engines, in particular diesel engines, in which in a first steady-state or quasi-steady state load condition of the internal combustion engine, a rail pressure is established as a function of the injection volume in accordance with a first characteristic curve, the rail pressure being established in a second, non-steady-state load condition of the internal combustion engine, in particular at non-steady-state full load, as a function of the injection volume in accordance with a second characteristic curve, the rail pressure in the case of the non-steady-state load condition being elevated in each case with respect to the rail pressure in the presence of the steady-state or quasi-steady-state load condition, with an identical injection volume.

12 Claims, 3 Drawing Sheets

METHOD FOR CONTROLLING A COMMON RAIL INJECTION SYSTEM

FIELD OF THE INVENTION

The present invention concerns a method for controlling a common rail injection system for internal combustion engines, in particular for turbochargeable diesel engines.

BACKGROUND INFORMATION

The requirements for successful application of a diesel injection system include varying the variation parameters, possible with a given set of injection equipment, in such a way that optimum results in terms of exhaust emissions, fuel consumption, and noise emission can be achieved.

In addition to variations in the components used, for example nozzles, injectors, etc., variation parameters in the case of common rail systems may include injection onset, rail pressure, and possibly additional injection events.

Non-steady-state processes, such as, for example, in the event of a sudden elevation in the load on a turbochargeable diesel engine, may result in a sudden boost pressure deficit that can result in a sudden sharp elevation in particulate emission. A boost pressure deficit of this kind may be counteracted by boost pressure-dependent limiting of the maximum injection volume. As a result of this action, however, the time required for full engine torque to be made available becomes longer.

With turbochargeable engines in particular, in contrast to conventional naturally aspirated engines, the matter of whether the engine is operating at a steady-state load (i.e., constant injection volume) or non-steady-state load is believed to be important. The reason is that in turbochargeable engines, the exhaust flow drives a turbine which in turns acts upon a compressor that forces fresh air into the combustion chamber. When more fuel is injected into the combustion chamber, the higher energy in the exhaust gas results in a higher boost pressure. The boost pressure therefore depends on the injection volume. A steady-state operating point (constant load and engine speed) therefore results in a balanced state, i.e. the turbocharger rotates at a constant speed. In non-steady-state load conditions, this balanced state does not exist. This may be explained by way of an example: Let us assume that an engine is running at an engine speed $N_1$, associated with which are a maximum permissible injection volume Me1, a boost pressure $p_1$, and a corresponding air volume $M_{L1}$ that is delivered by the turbocharger. If, however, the engine is transferred in non-steady-state fashion into this operating condition, the injection volume Me is abruptly increased from a smaller volume to the value $Me_1$. The turbocharger is at the same time delivering a boost pressure P2 that is less than $p_1$. The result, in the case of a non-steady-state load increase, is that the boost pressure and therefore combustion air are insufficient, and combustion is degraded. In this situation the engine would emit a smoke pulse during the non-steady-state load elevation. This smoke pulse not only is visible, but is also believed to have a negative effect on the particulate result in a transient emissions test.

To prevent or at least reduce this kind of smoke pulse, in the context of a non-steady-state load elevation, the injection volume has been limited as a function of the engine speed and the boost pressure (a so-called "smoke characteristics" diagram).

In U.S. Pat. No. 4,841,936 is discussed a fuel injection control apparatus of an internal combustion engine in which a number of fuel injectors are associated with a pressurized fuel accumulating chamber. Also provided are drivers for controlling the fuel to be delivered, as well as controllers for adapting the pressure in the pressure chamber to a predetermined value.

In European Patent 0 812 981 is discussed a method for controlling injection while a turbochargeable diesel engine is in a non-steady state, and in which injection pressure is varied with increasing engine load, although the pressure increase performed upon detection of a non-steady state is less than in the case of a corresponding steady state.

SUMMARY OF THE INVENTION

An object of an exemplary embodiment of the present invention is to provide a control system of a common rail injection system with which the total particulate emissions can be reduced, in a relatively simple fashion.

In particular, it is believed that an elevated injection pressure in the presence of a non-steady-state engine load condition made available by the exemplary method according to the present invention yields substantially better atomization and, as a result thereof, a substantially smaller smoke pulse. It is also believed that the elevated rail pressure is no longer necessary once the non-steady-state engine load condition has ended, since sufficient boost pressure is once again available, so the rail pressure can be lowered again to the normal level (as a function solely of the injection volume).

Advantageously, in the presence of a non-steady-state engine load the rail pressure is elevated by a constant amount in each case, as compared to the rail pressure in the presence of a steady-state engine load, with identical injection volumes. Adding a constant value to a steady-state characteristic curve in this manner can be accomplished easily and without complexity in terms of control engineering.

An exemplary differential rail pressure amount is 200–400 bar, in particular 300 bar. Rail pressure increases of this kind are easy to effect and result in advantageous changes in the characteristics of the internal combustion engine. It should be noted, however, that the rail pressure increase and the differential rail pressure amount need not be constant, and the pressure values indicated are only exemplary. The rail pressure increase can be selected without restriction and can be optimized, for example, as a function of engine parameters such as engine speed, load, or even other parameters.

According to an exemplary method of the present invention, a maximum permissible injection volume per internal combustion engine stroke is established as a function of a turbocharger pressure of the internal combustion engine in the first, steady-state or quasi-steady-state load condition in accordance with a first characteristic curve, and in a second, non-steady-state load condition in accordance with a second characteristic curve, the maximum permissible injection volume in the case of a non-steady-state load condition being elevated in each case with respect to the maximum permissible injection volume in a steady-state or quasi-steady-state load condition, at identical boost pressure. This action, of increasing the maximum injection volume in the presence of a non-steady-state load increase, makes it possible to achieve optimum elevation of the engine torque in response to a non-steady-state load increase as a function of a boost pressure. In this context, the full engine torque is present only when the boost pressure exceeds a specific point on a smoke characteristics diagram curve and the injection volume, governed by engine speed, cannot be increased further. The combination of the elevation according to the exemplary method of the present invention of the rail pressure or injection pressure with the simultaneous increase in the limit quantity in the so-called smoke characteristics diagram may result, in particular, in the following advantages: the maximum exhaust gas turbidity (target value of the volume increase in the smoke characteristics diagram) remains the same, while the smoke pulse is shortened, and total particle emissions are reduced. Full engine torque may be reached sooner than with other approaches, and more torque may be available to the driver during the load increase. In actual driving, this yields advantages when accelerating and moving from rest. The overall efficiency of an engine controlled by way of the exemplary method according to the present invention is improved, resulting, for example, in lower specific consumption. The exemplary method according to the present invention can be implemented in software, and available EDC sensors may be used.

It is believed to be particularly advantageous that the injection difference is 15–25 mg, in particular 21 mg, per stroke. With differences on this order, the elapsed time until, for example, approximately 90% of the steady-state full load torque is available can be decreased by approximately 30% In addition, up to 20% more torque is available to the driver during a non-steady-state phase. The injection difference or elevation in injection volume that is selected also does not necessarily need to be constant; here again, the values indicated are exemplary. In this case as well, the limit values can be selected without restriction in the context of optimization.

DETAILED DESCRIPTION

In contrast to cam-driven systems, with common rail systems there exists the possibility of selecting the injection pressure without restriction in the context of system limitations. The so-called "rail pressure characteristics diagram" stores the rail pressure as a function of engine speed and injection volume Me. For a constant engine speed, the rail pressure is thus a function solely of the injection volume Me. A rail pressure curve of this kind for a constant engine speed is labeled 10 in FIG. 1. It is evident that the rail pressure rises with increasing injection volume Me. At higher injection volumes, the rail pressure curve may be flat (constant rail pressure) or may also rise continuously.

Figure 1:
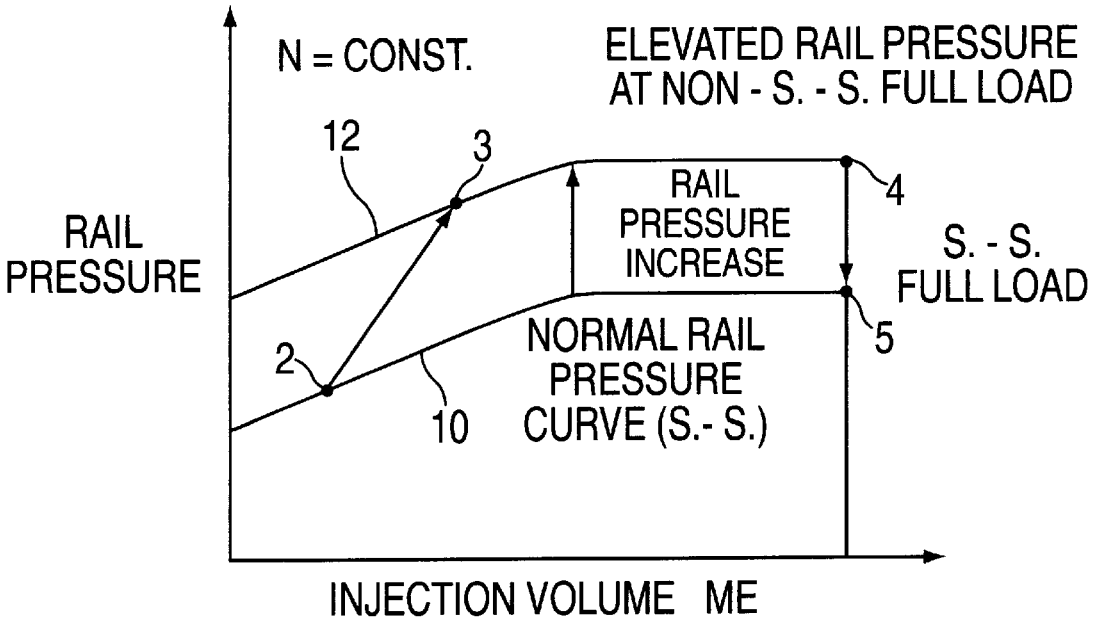
FIG. 1 shows a diagram of the action of increasing the rail pressure in the presence of a non-steady-state load condition, according to an exemplary method of the present invention.

Exemplary methods of the present invention concern a temporary superelevation of the rail pressure during a phase of non-steady-state engine load or full engine load. This elevation of the rail pressure as compared to the steady-state case is depicted in FIG. 1 by way of curve 12. To simplify the depiction, it is assumed in this context that curves 10 and 12 apply to the same constant engine speed. It is evident that in this case the rail pressure is elevated by a constant value by comparison with the steady-state case, over the entire permissible range of injection volumes. If, for example, at constant engine speed the accelerator pedal is completely depressed (transferring the engine, in the depiction of FIG. 1, from point 2 to point 3), then the rail pressure is increased as depicted. The degree of increase, which is not depicted in detail in FIG. 1, depends in particular on the engine speed and the level of the normal rail pressure curve (curve 10).

The elevated rail pressure or injection pressure is believed to result in better atomization and thus in a substantially smaller smoke pulse. The overall result during the phase of non-steady-state full load, as depicted in FIG. 1, is a curve extending from point 2 through point 3 to a point 4. Once the engine has left the non-steady-state phase (after point 4), the elevated rail pressure is no longer necessary and, because of the limited $NO_x$, emissions in the steady-state test, is also no longer permissible. Sufficient boost pressure is once again available, and the rail pressure is decreased back to the normal level (as a function solely of the injection volume), as depicted by way of point 5 in FIG. 1.

Figure 2:
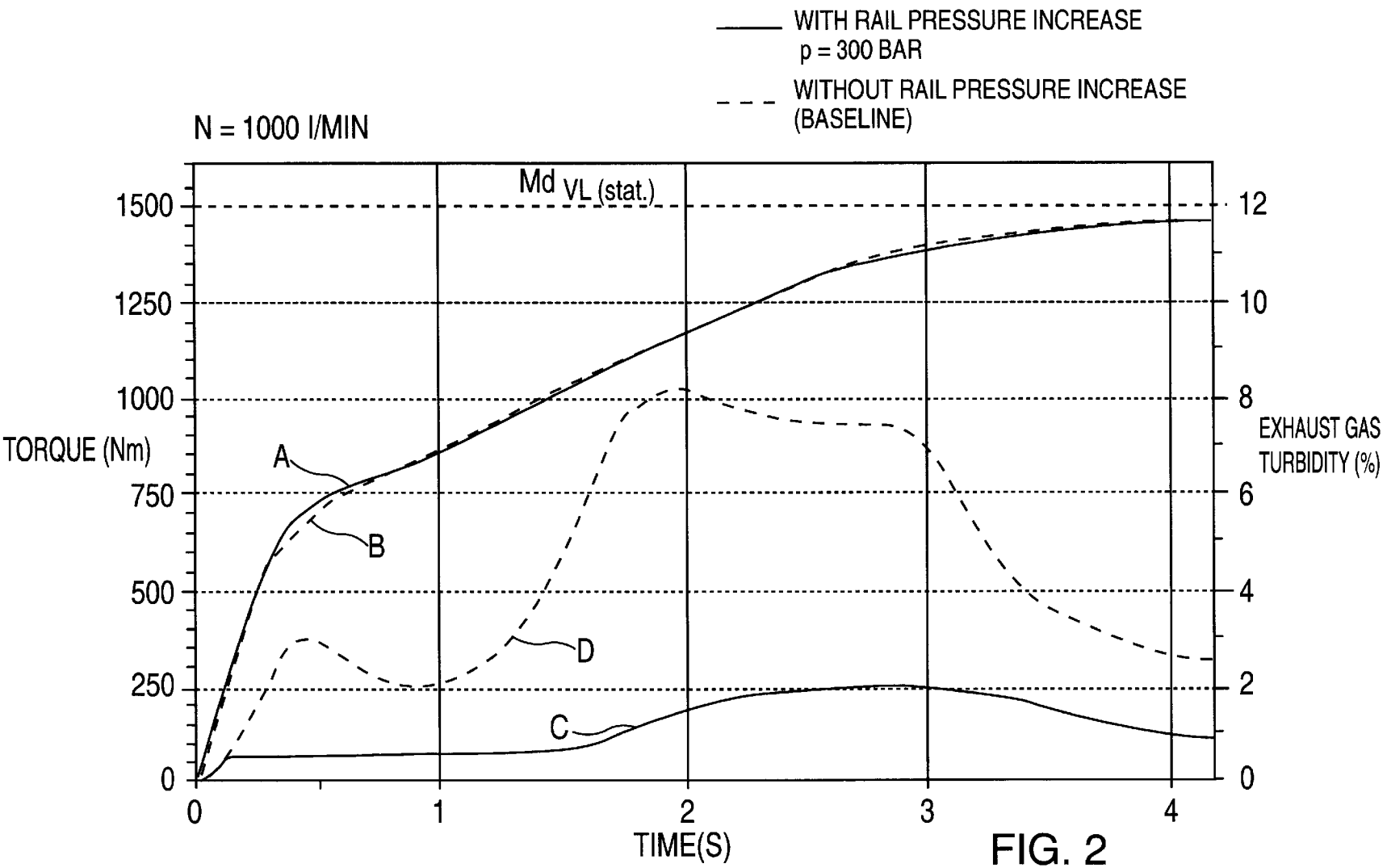
FIG. 2 shows a diagram of the torque and an exhaust gas turbidity value as a function of time, with and without the rail pressure increase, according to an exemplary method of the present invention.

FIG. 2 depicts the result achievable for an engine when the rail pressure elevation just described is applied at a rotation speed N=1000 rpm (=constant). Time is plotted on the abscissa, available torque on the left ordinate, and exhaust gas turbidity on the right ordinate.

Curves A and B show available torque as a function of time, and curves C, D show exhaust gas turbidity as a function of time, during a non-steady-state full load. The solid lines in each case indicate the curves when the rail pressure elevation according to the exemplary method of the present invention is used, and the dashed curves show the situation without a rail pressure increase. Exhaust gas turbidity is determined, for example, with a light absorption instrument (Celesco turbidity). A steady-state full-load injection volume $Me_1$=185 mg/stroke yields, for the example depicted, a steady-state full-load torque $Md_{VL(St)}$ of 1500 Nm.

It is evident that without the rail pressure elevation, a maximum turbidity of approximately 8% occurs in response to a load increase (curve D). This corresponds to a "Bosch blackening" number of approximately 3.2. If the rail pressure is then elevated (by 300 bar, in the example shown) during the load increase, then a maximum turbidity of only 2% is expelled (curve C), corresponding to a blackening number of approximately 1.7. The volume limitation for nonsteady-state full load was not changed in this context. The result is that there is no change in the torque curve (curves A, B).

The second feature provided according to the exemplary method of the present invention, namely elevation of the maximum permissible injection volume in the smoke characteristics diagram in the presence of non-steady-state full load, will now be explained with reference to FIG. 3. This depicts the maximum permissible injection volume Me as a function of the (corrected) boost pressure p made available by a turbocharger. Curve F (dashed line) represents the characteristic curve for a non-steady-state partial load, curve G the curve for a non-steady-state full load, and curve H the characteristic curve provided according to the exemplary method of the present invention for a non-steady-state full load with an increase in the limit volume for the case of an increase in rail pressure.

Conventionally, a transition from characteristic curve F to characteristic curve G took place as the engine moved from a static part load (curve F) to a non-steady-state full-load state. In other words, an elevation in the injection volume for a specific boost pressure was permitted in accordance with a transition from point 2 to point 3, but this injection volume elevation was selected in accordance with the characteristic curve for non-steady-state full load.

What is now provided for according to the exemplary method of the present invention in such a case is to permit an additional elevation of the injection volume, as depicted by characteristic curve H. It is evident that the characteristic curve profile is elevated by an approximately constant amount as compared to the profile of characteristic curve G. In the event of sudden acceleration or non-steady-state full load, the injection volume is therefore elevated from point 2 through point 3 of curve G to point 3' of curve H. The result is higher exhaust gas energy, so that the turbocharger can compress more air, with the overall result that the rising boost pressure makes possible a greater injection volume. As the non-steady-state full load condition depicted here continues, the characteristic curve H transitions via point 3' to point 4. Because of the limitation and gradual elevation of the injection volume along curve H depicted here, full torque becomes available only when the boost pressure exceeds point 4 and the injection volume cannot be elevated further (torque limitation of injection volume). The action according to the exemplary method of the present invention is thus to elevate the maximum permissible injection volume for a non-steady-state engine load condition as compared to the conventional maximum injection volume. It is noted that the elevation of the limit volume should be carried out only in conjunction with the rail pressure elevation. It is believed that optimum results can be obtained with this combination of actions.

This additional increase in the limit volume elevates the smoke pulse back to the permissible original value. In experiments, the limit volume was elevated, over the entire curve for non-steady-state full load (curve H), by $\Delta Me = Me1/stroke$ as compared to the curve for steady-state full load (curve G, which remained unchanged).

Figure 3:
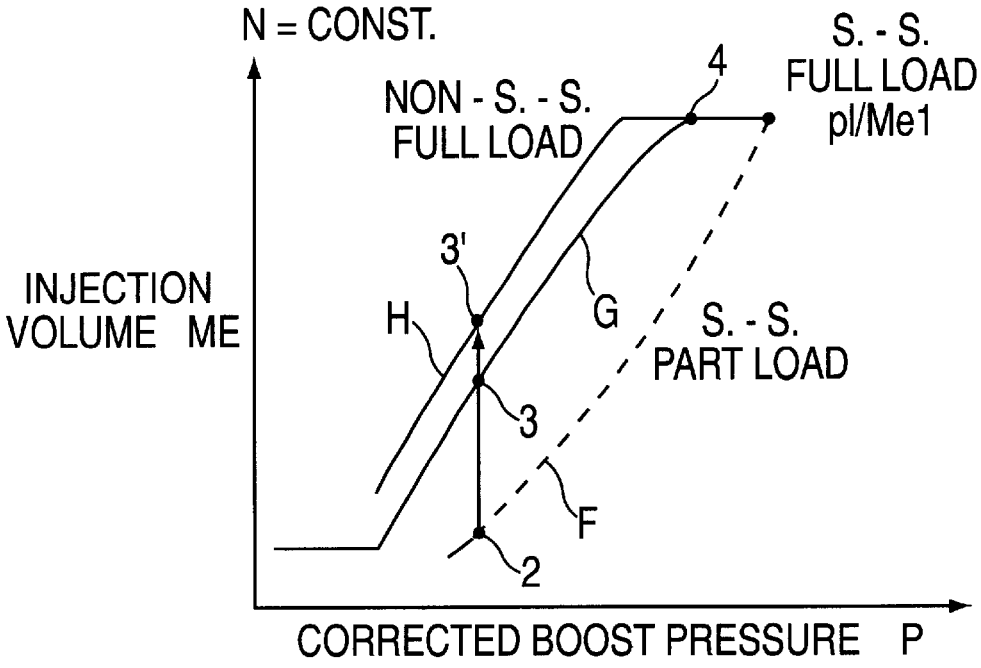
FIG. 3 shows a diagram of the action of elevating the maximum injection volume in the smoke characteristics diagram at non-steady-state full load.

The limit lines (for constant engine speed) plotted in FIG. 3 are stored, for example in an EDC device, as characteristics diagrams. Characteristic curve G already exists in the form of the smoke characteristics diagram. Characteristic curve H is stored as a new characteristics diagram. In addition, a new characteristics diagram for rail pressure elevation (rail pressure elevation $\Delta p = f$(engine speed, injection volume)) is stored. This characteristics diagram is in turn activated as a function of the characteristic curves or characteristics diagrams G, H, which in turn are a function of engine speed and boost pressure. Three cases can now be distinguished: if a non-steady-state injection volume lying below characteristic curve G is desired, no action is necessary. If, however, a non-steady-state injection volume that lies above characteristic curve H is desired, the volume is limited in accordance with characteristic curve H and at the same time the rail pressure is elevated in accordance with the new characteristics diagram for rail pressure elevation. Lastly, if a non-steady-state injection volume that lies between characteristic curves G and H is desired, that volume is enabled and at the same time the rail pressure is elevated in accordance with the characteristics diagram.

Figure 4:
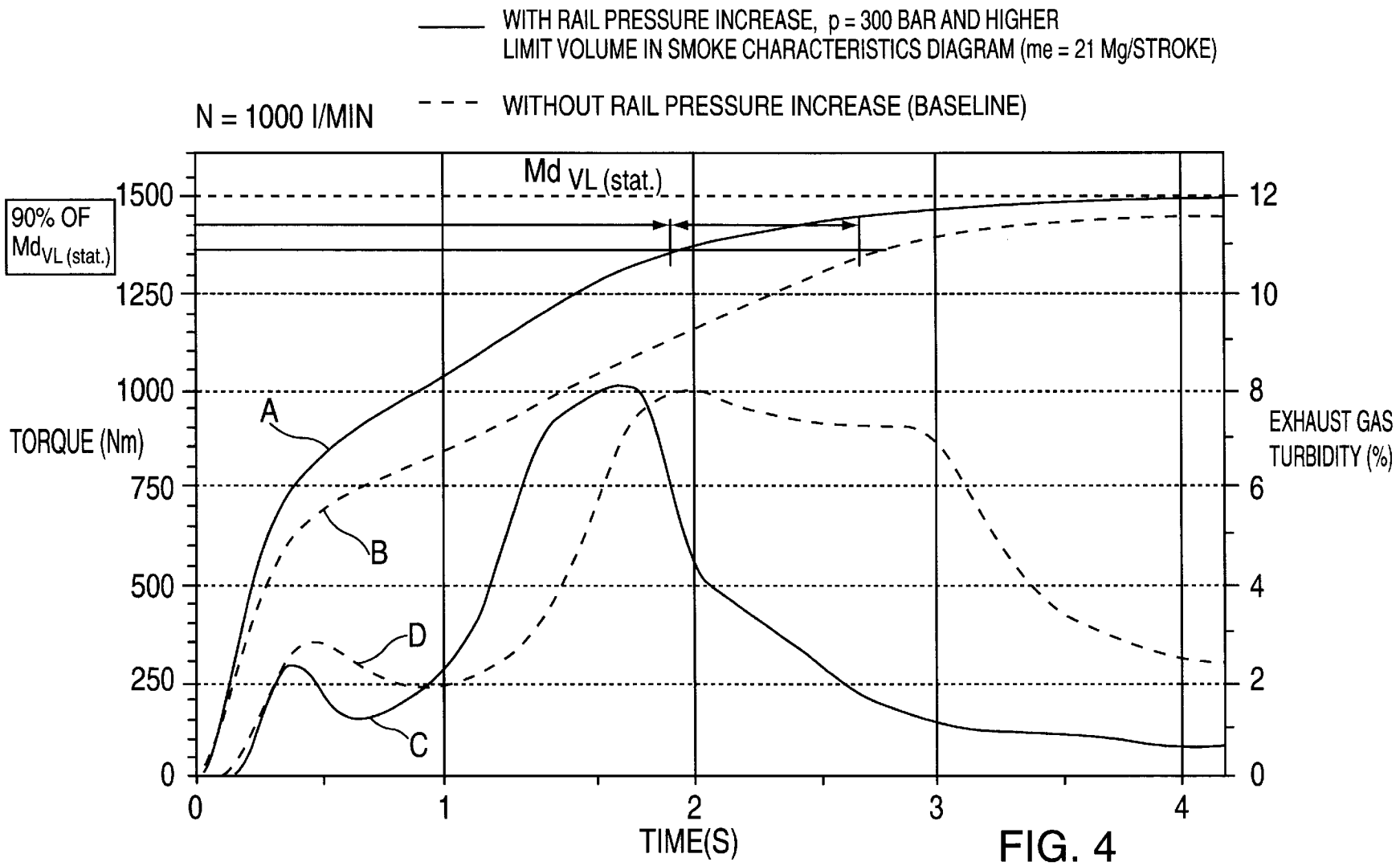
FIG. 4 shows a diagram corresponding to FIG. 2 for the case of an additionally provided elevation of the maximum injection volume.

The results attainable with this action are depicted in FIG. 4, in which curves A, B symbolize the change in torque over time at non-steady-state full load, and curves D, E represent the corresponding exhaust gas turbidity. The solid lines show situations in which a rail pressure increase and an elevated maximum injection volume are provided, and the dashed lines show the baseline situation as shown in FIG. 2, i.e. with no rail pressure increase and without the additional elevation of the maximum injection volume as defined by characteristic curve H of FIG. 3.

FIG. 4 illustrates three advantages that can be achieved with the aforesaid combination of a rail pressure increase and an additional elevation of the maximum injection volume. The maximum value for turbidity is not reduced as compared to the original state (approximately 8% in each case for curves C and D), but the integrated turbidity (area under curves C and D, respectively) is lower, since the non-steady-state phase is shorter. This should correspond to a decrease in total particulate emissions.

Good adaptation of the smoke characteristics diagram is usually evaluated on the one hand by observing the maximum smoke pulse, and on the other hand by determining the time required for 90% of the steady-state full-load torque $Md_{vL(Stat)}$ to be available. It is evident from FIG. 4 that this time is approximately 2.7 seconds in the baseline state (without rail pressure increase and additional injection volume elevation). With the rail pressure elevation provided for according to the exemplary method of the present invention and an additional increase in the limit quantity in the smoke characteristics diagram, this time is shortened to 1.9 seconds, corresponding to a decrease of approximately 30%. The result of the actions according to the exemplary method of the present invention is that greater acceleration torque is made available, and that steady-state full-load torque is reached more quickly.

Lastly, not only is full torque reached more quickly, but as much as 20% more torque may be available during the non-steady-state phase. This is believed to be a considerable advantage for driving situations in which the accelerator pedal position is constantly changing.

To conclude, the advantages achievable according to the exemplary method of the present invention will be summarized once again. If, in the event of a sudden increase in the load on a turbocharged diesel engine, the injection pressure is increased (as compared to the steady-state condition) during a non-steady-state phase and at the same time the limit quantity in the so-called smoke characteristics diagram is also elevated, the following effects occur. While maximum exhaust gas turbidity (target value for the volume increase in the smoke characteristics diagram) remains the same, the smoke pulse is shortened and total particulate emissions are reduced. Full torque may be achieved at an earlier point in time compared to other approaches. A higher level of torque is available to the driver during the load increase, yielding driving advantages when accelerating and moving from rest. The efficiency of the engine is improved during the rail pressure increase (lower specific consumption).

What is claimed is:

1. A method for controlling a common rail injection system for a turbochargeable internal combustion engine, the method comprising the steps of:

establishing a rail pressure as a function of an injection volume according to a first characteristic curve in one of a steady-state load condition and a quasi-steady state load condition of the internal combustion engine;

establishing the rail pressure as a function of the injection volume according to a second characteristic curve in a non-steady-state load condition of the internal combustion engine; and elevating the rail pressure in the non-steady-state load condition with respect to the rail pressure in a presence of the one of the steady-state load condition and the quasi-steady-state load condition, with the injection volume.

2. The method of claim 1, wherein the second characteristic curve differs from the first characteristic curve by a constant differential rail pressure amount.

3. The method of claim 1, wherein the rail pressure corresponds to a differential rail pressure, and the method further comprises the step of:

performing one of a selection and an optimization of the differential rail pressure based on at least one internal combustion engine parameter.

4. The method of claim 2, wherein the rail pressure corresponds to a differential rail pressure, and wherein the differential rail pressure is 200 bar to 400 bar.

5. The method of claim 4, wherein the differential rail pressure is 300 bar.

6. The method of claim 1, wherein the internal combustion engine corresponds to a diesel engine.

7. The method of claim 1, wherein the non-steady-state load condition corresponds to a non-steady-state full load.

8. A method for controlling a common rail injection system for a turbochargeable internal combustion engine, the method comprising the steps of:

establishing a rail pressure as a function of an injection volume according to a first characteristic curve in one of a steady-state load condition and a quasi-steady state load condition of the internal combustion engine;

establishing the rail pressure as a function of the injection volume according to a second characteristic curve in a non-steady-state load condition of the internal combustion engine;

elevating the rail pressure in the non-steady-state load condition with respect to the rail pressure in a presence of the one of the steady-state load condition and the quasi-steady-state load condition, with the injection volume;

establishing a maximum permissible injection volume per internal combustion engine stroke as a function of a turbocharger pressure of the internal combustion engine in the one of the steady-state load condition and the quasi-steady-state load condition according to the first characteristic curve and in the non-steady-state load condition in accordance with the second characteristic curve; and elevating the maximum permissible injection volume in the non-steady-state load condition with respect to the maximum permissible injection volume in the one of the steady-state load condition and the quasi-steady-state load condition, at an identical boost pressure.

9. The method of claim 8, wherein the second characteristic curve corresponds to a second injection volume characteristic curve, wherein the first characteristic curve corresponds to a first injection volume characteristic curve, and wherein the second injection volume characteristic curve differs at least partially from the first injection volume characteristic curve by a substantially constant injection volume difference amount.

10. The method of claim 9, further comprising the step of:

performing one of a selection and an optimization of the substantially constant injection volume difference amount based on at least one of internal combustion engine parameters and emission parameters.

11. The method of claim 9, wherein the substantially constant injection volume difference amount is between 15 mg per stroke to 25 mg per stroke.

12. The method of claim 11, wherein the substantially constant injection volume difference is 21 mg per stroke.

* * * * *